US010047950B2

(12) United States Patent
Ruiz et al.

(10) Patent No.: US 10,047,950 B2
(45) Date of Patent: Aug. 14, 2018

(54) OSCILLATING COMBUSTOR WITH PULSED CHARGER

(71) Applicant: ClearSign Combustion Corporation, Seattle, WA (US)

(72) Inventors: Roberto Ruiz, Sammamish, WA (US); Joseph Colannino, Bellevue, WA (US); Igor A. Krichtafovitch, Kirkland, WA (US); Christopher A. Wiklof, Everett, WA (US)

(73) Assignee: CLEARSIGN COMBUSTION CORPORATION, Seattle, WA (US)

( * ) Notice: Subject to any disclaimer, the term of this patent is extended or adjusted under 35 U.S.C. 154(b) by 132 days.

(21) Appl. No.: 15/165,914

(22) Filed: May 26, 2016

(65) Prior Publication Data

US 2016/0265765 A1 Sep. 15, 2016

Related U.S. Application Data

(62) Division of application No. 14/187,077, filed on Feb. 21, 2014, now Pat. No. 9,377,189.

(60) Provisional application No. 61/767,750, filed on Feb. 21, 2013, provisional application No. 61/767,608, filed on Feb. 21, 2013.

(51) Int. Cl.

| | |
|---|---|
| ***F23N 5/00*** | (2006.01) |
| ***F23C 99/00*** | (2006.01) |
| ***F23C 5/00*** | (2006.01) |
| ***F23C 15/00*** | (2006.01) |
| ***F23N 5/20*** | (2006.01) |

(52) U.S. Cl.

CPC ..... *F23C 99/001* (2013.01); *F23C 5/00* (2013.01); *F23C 15/00* (2013.01); *F23N 5/20* (2013.01); *F23C 99/00* (2013.01)

(58) Field of Classification Search

CPC ..... C23C 99/001; F23C 99/00; F23N 5/00
USPC ..... 431/2, 8, 253, 268; 60/772, 779
See application file for complete search history.

(56) References Cited

U.S. PATENT DOCUMENTS

| | | | |
|---|---|---|---|
| 2,604,936 | A | 7/1952 | Kaehni et al. |
| 3,087,472 | A | 4/1963 | Asakawa |
| 3,167,109 | A | 1/1965 | Wobig |
| 3,306,338 | A | 2/1967 | Wright et al. |

(Continued)

FOREIGN PATENT DOCUMENTS

| | | |
|---|---|---|
| EP | 0844434 | 5/1998 |
| EP | 1139020 | 8/2006 |

(Continued)

OTHER PUBLICATIONS

Timothy J.C. Olmansley et al., "Electrical Modification of Combustion and the Affect of Electrode Geometry on the Field Produced," Modelling and Simulation in Engineering, May 26, 2011, 1-13, vol. 2011, Himdawi Publishing Corporation.

(Continued)

*Primary Examiner* — Gregory Huson
*Assistant Examiner* — Nikhil Mashruwala
(74) *Attorney, Agent, or Firm* — Christopher A. Wiklof; Nicholas S. Bromer; Launchpad IP, Inc.

(57) ABSTRACT

An oscillating combustor can support a time-sequenced combustion reaction having rich and lean phases by applying a variable voltage charge to a fuel stream or flame that flows adjacent to a conductive or semiconductive flame holder held in electrical continuity with an activation voltage.

23 Claims, 6 Drawing Sheets

(56) References Cited

U.S. PATENT DOCUMENTS

| | | | |
|---|---|---|---|
| 3,358,731 | A | 12/1967 | Donnelly |
| 3,416,870 | A | 12/1968 | Wright |
| 3,749,545 | A | 7/1973 | Velkoff |
| 4,020,388 | A | 4/1977 | Pratt, Jr. |
| 4,111,636 | A | 9/1978 | Goldberg |
| 4,340,024 | A | 7/1982 | Suzuki et al. |
| 4,430,024 | A | 2/1984 | Guild et al. |
| 5,049,063 | A | 9/1991 | Kishida et al. |
| 5,515,681 | A | 5/1996 | DeFreitas |
| 5,702,244 | A | 12/1997 | Goodson et al. |
| 5,784,889 | A | 7/1998 | Joos et al. |
| 6,247,921 | B1 | 6/2001 | Helt |
| 7,137,808 | B2 | 11/2006 | Branston et al. |
| 7,159,646 | B2 | 1/2007 | Dessiatoun et al. |
| 7,243,496 | B2 | 7/2007 | Pavlik et al. |
| 7,523,603 | B2 | 4/2009 | Hagen et al. |
| 7,845,937 | B2 | 12/2010 | Hammer et al. |
| 8,245,951 | B2 | 8/2012 | Fink et al. |
| 8,851,882 | B2 | 10/2014 | Hartwick et al. |
| 8,881,535 | B2 | 11/2014 | Hartwick et al. |
| 8,911,699 | B2 | 12/2014 | Colannino et al. |
| 9,151,549 | B2 | 10/2015 | Goodson et al. |
| 9,209,654 | B2 | 12/2015 | Colannino et al. |
| 9,243,800 | B2 | 1/2016 | Goodson et al. |
| 9,267,680 | B2 | 2/2016 | Goodson et al. |
| 9,284,886 | B2 | 3/2016 | Breidenthal et al. |
| 9,289,780 | B2 | 3/2016 | Goodson |
| 9,310,077 | B2 | 4/2016 | Breidenthal et al. |
| 9,366,427 | B2 | 6/2016 | Sonnichsen et al. |
| 9,377,188 | B2 | 6/2016 | Ruiz et al. |
| 9,377,195 | B2 | 6/2016 | Goodson et al. |
| 2005/0208442 | A1 | 9/2005 | Heiligers et al. |
| 2006/0165555 | A1 | 7/2006 | Spielman et al. |
| 2007/0020567 | A1 | 1/2007 | Branston et al. |
| 2010/0183424 | A1 | 7/2010 | Roy |
| 2013/0071794 | A1 | 3/2013 | Colannino et al. |
| 2013/0230810 | A1 | 9/2013 | Goodson et al. |
| 2013/0260321 | A1 | 10/2013 | Colannino et al. |
| 2013/0291552 | A1 | 11/2013 | Smith et al. |
| 2013/0323655 | A1 | 12/2013 | Krichtafovitch et al. |
| 2013/0323661 | A1 | 12/2013 | Goodson et al. |
| 2013/0333279 | A1 | 12/2013 | Osler et al. |
| 2013/0336352 | A1 | 12/2013 | Colannino et al. |
| 2014/0051030 | A1 | 2/2014 | Colannino et al. |
| 2014/0065558 | A1 | 3/2014 | Colannino et al. |
| 2014/0076212 | A1 | 3/2014 | Goodson et al. |
| 2014/0080070 | A1 | 3/2014 | Krichtafovitch et al. |
| 2014/0162195 | A1 | 6/2014 | Lee et al. |
| 2014/0162196 | A1 | 6/2014 | Krichtafovitch et al. |
| 2014/0162197 | A1 | 6/2014 | Krichtafovitch et al. |
| 2014/0162198 | A1 | 6/2014 | Krichtafovitch et al. |
| 2014/0170569 | A1 | 6/2014 | Anderson et al. |
| 2014/0170571 | A1 | 6/2014 | Casasanta, III et al. |
| 2014/0170575 | A1 | 6/2014 | Krichtafovitch |
| 2014/0170576 | A1 | 6/2014 | Colannino et al. |
| 2014/0170577 | A1 | 6/2014 | Colannino et al. |
| 2014/0186778 | A1 | 7/2014 | Colannino et al. |
| 2014/0196368 | A1 | 7/2014 | Wiklof |
| 2014/0196369 | A1 | 7/2014 | Wiklof |
| 2014/0208758 | A1 | 7/2014 | Breidenthal et al. |
| 2014/0212820 | A1 | 7/2014 | Colannino et al. |
| 2014/0216401 | A1 | 8/2014 | Colannino et al. |
| 2014/0227645 | A1 | 8/2014 | Krichtafovitch et al. |
| 2014/0227646 | A1 | 8/2014 | Krichtafovitch et al. |
| 2014/0227649 | A1 | 8/2014 | Krichtafovitch et al. |
| 2015/0079524 | A1 | 3/2015 | Colannino et al. |
| 2015/0107260 | A1 | 4/2015 | Colannino et al. |
| 2015/0118629 | A1 | 4/2015 | Colannino et al. |
| 2015/0121890 | A1 | 5/2015 | Colannino et al. |
| 2015/0140498 | A1 | 5/2015 | Colannino |
| 2015/0147704 | A1 | 5/2015 | Krichtafovitch et al. |
| 2015/0147705 | A1 | 5/2015 | Colannino et al. |
| 2015/0147706 | A1 | 5/2015 | Krichtafovitch et al. |
| 2015/0170578 | A1 | 6/2015 | Choi |
| 2015/0219333 | A1 | 8/2015 | Colannino et al. |
| 2015/0241057 | A1 | 8/2015 | Krichtafovitch et al. |
| 2015/0338089 | A1 | 11/2015 | Krichtafovitch et al. |
| 2015/0345780 | A1 | 12/2015 | Krichtafovitch |
| 2015/0345781 | A1 | 12/2015 | Krichtafovitch et al. |
| 2015/0362178 | A1 | 12/2015 | Karkow et al. |
| 2016/0123576 | A1 | 5/2016 | Colannino et al. |
| 2016/0161115 | A1 | 6/2016 | Krichtafovitch et al. |
| 2017/0122553 | A1* | 5/2017 | Krichtafovitch ..... F23C 99/001 |
| 2017/0267729 | A1* | 9/2017 | Bock ..... A61K 39/145 |

FOREIGN PATENT DOCUMENTS

| | | |
|---|---|---|
| EP | 2738460 | 6/2014 |
| FR | 2577304 | 12/1989 |
| GB | 932955 | 7/1963 |
| GB | 1042014 | 9/1966 |
| JP | 58-019609 | 2/1983 |
| JP | 60-216111 | 10/1985 |
| JP | 61-265404 | 11/1986 |
| JP | 2001-021110 | 1/2001 |
| WO | WO 1996/001394 | 1/1996 |
| WO | WO 2012/109499 | 8/2012 |
| WO | WO 2013/181569 | 12/2013 |

OTHER PUBLICATIONS

James Lawton and Felix J. Weinberg. "Electrical Aspects of Combustion." Clarendon Press, Oxford. 1969, p. 81.

James Lawton and Felix J. Weinberg. "Electrical Aspects of Combustion." Clarendon Press, Oxford. 1969, p. 158.

* cited by examiner

OSCILLATING COMBUSTOR WITH PULSED CHARGER

CROSS-REFERENCE TO RELATED APPLICATIONS

The present application is a Divisional application of U.S. patent application Ser. No. 14/187,077, entitled "METHOD FOR OPERATING AN OSCILLATING COMBUSTOR WITH PULSED CHARGER," filed Feb. 21, 2014; which application claims priority benefit from U.S. Provisional Patent Application No. 61/767,750, entitled "OSCILLATING COMBUSTOR WITH PULSED CHARGER," filed Feb. 21, 2013; and U.S. Provisional Patent Application No. 61/767,608, entitled "OSCILLATING COMBUSTOR," filed Feb. 21, 2013; each of which, to the extent not inconsistent with the disclosure herein, is incorporated herein by reference.

The present application is related to U.S. Non-Provisional application Ser. No. 14/187,066, entitled "OSCILLATING COMBUSTOR," filed Feb. 21, 2014, which is also incorporated by reference herein.

BACKGROUND

Oscillating combustors have received attention for providing time-sequenced combustion at two or more fuel/oxidizer mixtures. To date, valve systems for controlling fuel and/or oxidizer-entrained fluids have been challenging, especially with respect to reliability. Other shortcomings may also benefit from approaches described herein.

SUMMARY

What is needed is a high reliability, simple, exposed mechanism, low cost, high performance, and/or high precision oscillating combustor. Such a combustor can benefit from causing a flame to periodically carry an applied charge.

According to an embodiment, an oscillating combustor includes a fuel nozzle configured to emit an expanding area—i.e., diverging—fuel jet, a first flame holder disposed distally along the fuel jet and a second flame holder disposed proximally along the fuel jet. In one embodiment, an ionizer is positioned adjacent to a fuel trajectory of the fuel jet and configured to apply a varying or oscillating charge to the fuel jet or to a flame supported by the fuel jet. In another embodiment, a charge electrode is positioned in electrical contact with a flame supported by the fuel jet. A location of the flame is oscillated between positions near the first and second flame holders in response to variations of the charge applied by the ionizer. Fuel dilution varies with distance along the fuel jet, so varying a distance from the nozzle at which combustion occurs will also vary the composition of the fuel/oxidizer mixture of the flame. An oscillating charge applied by the ionizer can cause oscillation of a combustion mixture supported by a substantially constant flow rate fuel jet.

According to an embodiment, a method for supporting an oscillating combustion reaction includes applying an oscillating electrical charge or voltage to a diverging fuel jet or a combustion reaction supported by the fuel jet, while maintaining an activation voltage potential on at least one of two flame holders disposed at respective distances along the diverging fuel jet. When an electrical charge of sufficient magnitude is applied to the fuel jet or combustion reaction, the flame is attracted to the flame holder at which an opposing activation voltage is present, causing the flame to move toward that flame holder. If the opposing activation voltage is applied to a proximal one of the two flame holders, the flame can be held in a proximal flame front position by the proximal flame holder or can oscillate in position between the flame holders responsive to oscillations of the applied electrical charge. When the applied electrical charge is discontinued, the flame can disengage from the proximal flame holder and the flame front can move toward the more distal flame holder.

DETAILED DESCRIPTION

Figure 1A:
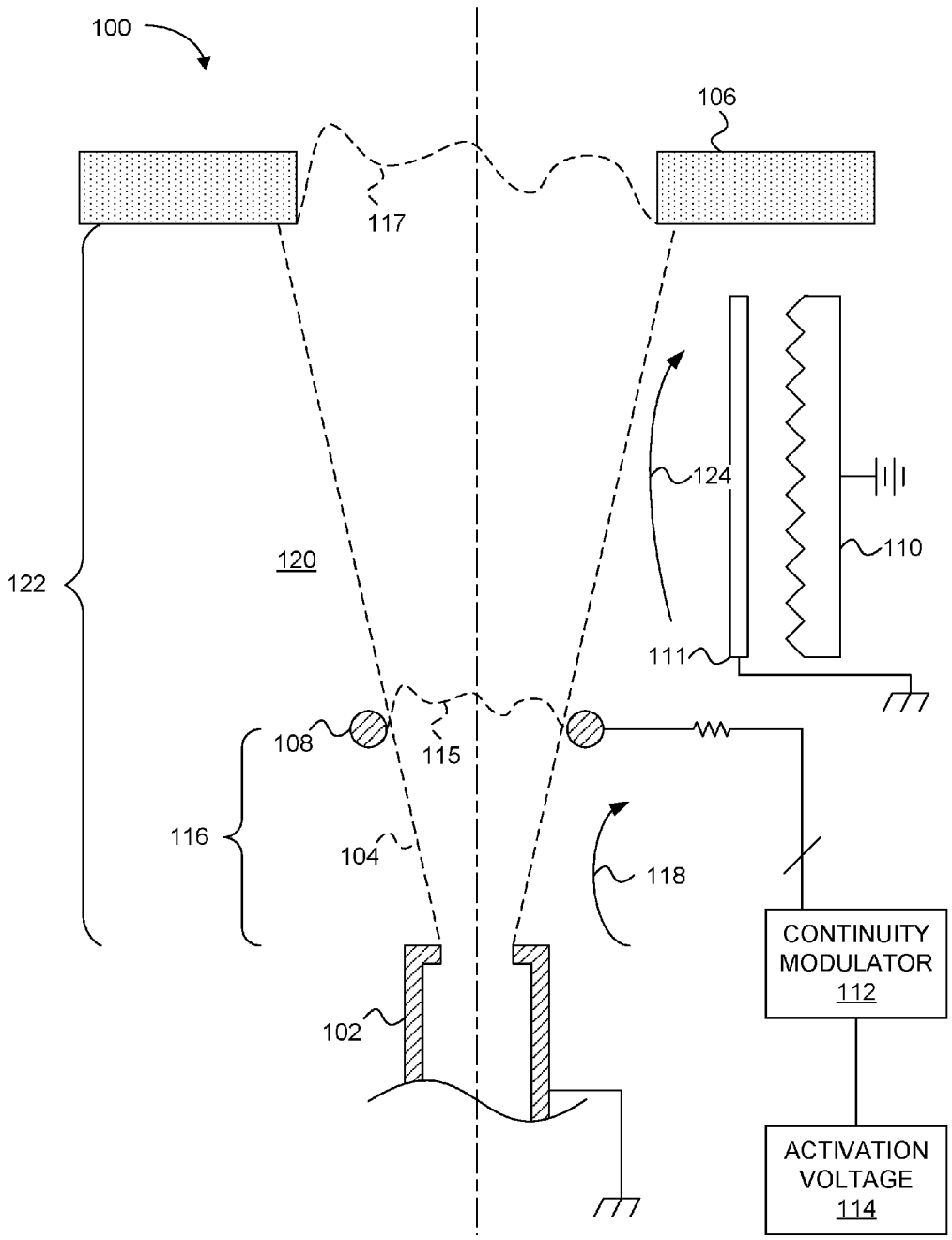
FIG. 1A is a sectional diagram of an oscillating combustor configured to support combustion with an oscillating fuel mixture responsive to interaction between an electrical charge continuously applied to a combustion fluid and a modulated electrical continuity a conductive flame holder, according to an embodiment.

In the following detailed description, reference is made to the accompanying drawings, which form a part hereof. In the drawings, similar symbols typically identify similar components, unless context dictates otherwise. Other embodiments may be used and/or other changes may be made without departing from the spirit or scope of the disclosure.

As used herein, "oscillating" combustion can be understood to refer to combustion that occurs in a series of packets having relatively high fuel concentration that are interleaved with a series of packets having relatively low fuel concentration. In embodiments herein, ignition can be substantially continuous, but can occur in a repeating sequence of two or more fuel concentrations, which can be referred to herein as "rich" and "lean" mixtures.

As used herein "combustion fluid" refers collectively to a fuel mixture and to a flame supported by the fuel mixture.

Owing to the oscillating position of the flame (described below) the relationship between the location of structures described below and the flame and/or fuel mixture can vary responsive to the position of the flame. As will be appreciated, various choices for relative position of the structures are also contemplated. It will be understood that, in any given embodiment, the location of structures does not change.

FIG. 1 is a diagram of an oscillating combustor 100 configured to support a combustion reaction 115, 117 that oscillates in fuel richness responsive to interaction between an electrical charge continuously applied to a combustion fluid and a continuity-modulated conductive or semiconductive flame holder 108, according to an embodiment. The oscillating combustor 100 includes a fuel nozzle 102 configured to emit an expanding area fuel jet 104. The fuel nozzle 102 can be configured to emit a continuous rate fuel jet. The expanding area fuel jet 104 entrains air and/or flue gas as it passes upward, such that the mixture varies from rich to lean as the jet travels away from the fuel nozzle 102. At a flame front 115, 117, the air entrainment stops because the air cannot pass through the flame sheath 115, 117. Accordingly, oscillating the position of the flame between a first flame front 117, and a second flame front 115 will oscillate the fuel mixture. Optionally, the fuel nozzle 102 can include a valve structure configured to modulate the flow rate of the fuel jet 104, and the modulation of voltage on the flame holder 108 can interact with the physically modulated fuel jet 104.

A first flame holder (which can be referred to as a distal flame holder) 106 is disposed distally along the fuel jet 104. A second flame holder (which can be referred to as a proximal flame holder) 108 is disposed proximally along the fuel jet 104.

An ionizer 110 including a corona electrode is configured to apply a charge to the fuel jet 104 and/or a flame supported by the fuel jet 104. Optionally, a counter electrode 111 can be disposed between the ion-ejecting electrode 110 and fuel stream 104 or between the ion-ejecting electrode 110 and the flame 115 to direct ejected charged particles toward the fuel stream 104 or flame 115. As indicated above, the position of the ion-ejecting electrode 110 can be held constant. Whether the combustion fluid is the fuel stream 104 or the flame 115, 117 depends on the instantaneous position of the flame 115, 117.

The second flame holder 108 can be formed of a conductive material. Additionally or alternatively, the second flame holder 108 can be formed from a semiconductive material. Alternatively, a conductive or semiconductive structure can be disposed near or in the second flame holder 108. For cases where there is a current-conductive structure disposed near or in the second flame holder 108, for ease of understanding the description herein will simply refer to the second flame holder as providing the current conduction.

A continuity modulator 112 is operatively coupled to the second flame holder 108 and is configured to modulate the second flame holder 108 with a time-varying continuity to an activation voltage 114. The activation voltage 114 can consist essentially of a voltage ground. Additionally or alternatively, the ionizer 110 can be configured to apply a first polarity charge to the fuel jet 104 and/or flame. The activation voltage 114 can consist essentially of a voltage opposite in polarity to the first polarity.

The ionizer 110 can be configured to apply charges to the fuel jet 104 and/or flame supported by the fuel jet 104 at a sufficiently high rate to cause the flame to carry a high voltage. The high voltage can be ±1000 V or greater (in absolute value). The high voltage can include an AC voltage or other time-varying voltage, or can be a DC voltage. The ionizer 110 can be configured to cause the flame to carry a voltage of about 10 kilovolts or more, for example.

The continuity modulator 112 can be configured to cause a flame front 115, 117 to oscillate between a position at or near the first flame holder 106 and a position at or near the second flame holder 108. A rich flame front 115 can be held at or near the second flame holder 108 when the second flame holder is in continuity with the activation voltage. A lean flame front 117 can be held at or near the first flame holder 106 when the second flame holder is switched to not be in continuity with the activation voltage. The continuity modulator 112 can be configured to selectively provide electrical continuity between the activation voltage 114 and the second flame holder 108 to hold the flame at or near the second flame holder 108. The continuity modulator 112 can also be configured to selectively break electrical continuity between the activation voltage 114 and the second flame holder 108 to hold the flame at or near the first flame holder 106. According to an embodiment, the continuity modulator 112 can be configured to periodically make and break continuity between the activation voltage 114 and the second flame holder 108. The flame front can responsively periodically cycle between a position corresponding to the second flame holder 108 and a position corresponding to the first flame holder 106.

The second flame holder 108 can be disposed at a distance 116 from the fuel nozzle 102. The expansion of the fuel jet 104 corresponds to entrainment (shown symbolically as 118) of a surrounding fluid 120 (typically air and/or flue gas). The distance 116 can be selected to correspond to fluid entrainment sufficient to (on a time-average) raise a concentration of oxidizer in the fuel jet 104 and/or reduce a concentration of fuel in the fuel jet 104 to cause the fuel concentration at the second flame holder 108 to be near a rich flammability limit of the fuel. Additionally or alternatively, the concentration of the fuel at the second flame holder 108 can simply be richer than the concentration of fuel near the first flame holder 106 if the flame is not anchored to the second flame holder 108.

When the flame is anchored to the second flame holder 108, a flame sheath around the fuel jet 104 at locations distal from the second flame holder 108 can cause surrounding fluid entrainment to stop. This is typically responsive to imposition of a stoichiometric mixture at the flame sheath corresponding to the combustion chemistry.

The first flame holder 106 can be disposed at a distance 122 from the fuel nozzle 102. The expansion of the fuel jet 104 corresponds to entrainment (shown symbolically as 118+124) of the surrounding fluid 120. The distance 122 can be selected to correspond to fluid entrainment sufficient to (on a time-average) raise a concentration of oxidizer or reduce the concentration of fuel in the fuel jet 104 to cause the fuel concentration to be at or near a lean flammability limit of the fuel. Additionally or alternatively, the concentration of the fuel near the first flame holder 106 can simply be leaner than the concentration of the fuel near the second flame holder 108.

Vortex shedding by the expanding fuel jet 104 can cause instantaneous peak fuel concentration to vary with respect to lateral or span-wise distance from a centerline of a fuel jet trajectory. The peak fuel concentration can tend to decrease and a time-averaged distribution of fuel concentration in a direction lateral to the main fuel propagation axis can tend to broaden with the distance 122 of the fuel jet 104 from the nozzle 102.

The continuity modulator 112 can be configured to cause the flame to oscillate in positions corresponding to oscillation between a rich mixture and a lean mixture. The rich mixture can include a time-averaged oxidizer concentration near a rich flammability limit of the fuel. The lean mixture can include a time-averaged oxidizer concentration near a lean flammability limit of the fuel. Alternatively, the flame can be driven to not oscillate in holding positions per se, but rather can move in a varying position between the first flame holder 106 and the second flame holder 108.

Figure 1B:
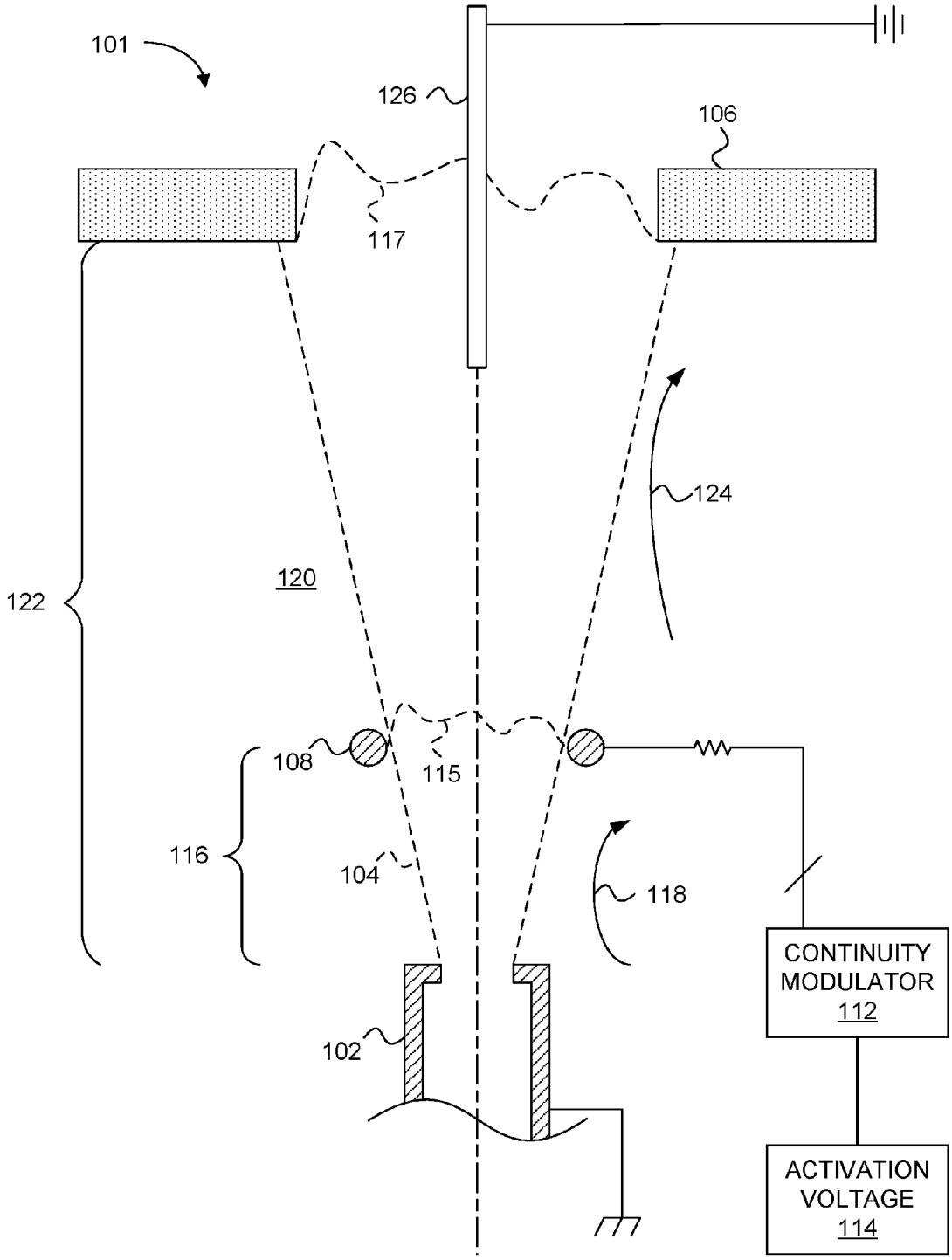
FIG. 1B is a sectional diagram of an oscillating combustor configured to support combustion with an oscillating fuel mixture responsive to interaction between an electrical charge continuously applied to a combustion fluid and a modulated electrical continuity a conductive flame holder, according to another embodiment.

FIG. 1B is a diagram showing an alternative embodiment 101 where the ionizer 110 is replaced by a charge electrode 126 that is in contact with the flame 115, 117.

Referring to both FIGS. 1A and 1B, various hardware embodiments of the continuity modulator 112 are contemplated. The continuity modulator 112 can include a transistor, such as, an insulated gate bipolar transistor (IGBT). Alternatively, the continuity modulator can include a mechanical switch, a relay, a solid state relay, a reed switch, discrete electrical components, a mercury switch, a cascade of transistors, and/or one or a cascade of tubes, for example.

The oscillating combustor 100, 101 can be configured to combust a time-series of rich and lean combustion packets. The rich combustion packets can have about 50% to 70% of the amount of oxygen required for stoichiometric combustion, for example. The lean combustion packets can have about 130% to 150% the amount of oxygen required for stoichiometric combustion, for example. The continuity modulator 112 can be configured to modulate the holding position of the flame at a frequency of between about 0.5 and 15 Hertz, for example.

Figure 2A:
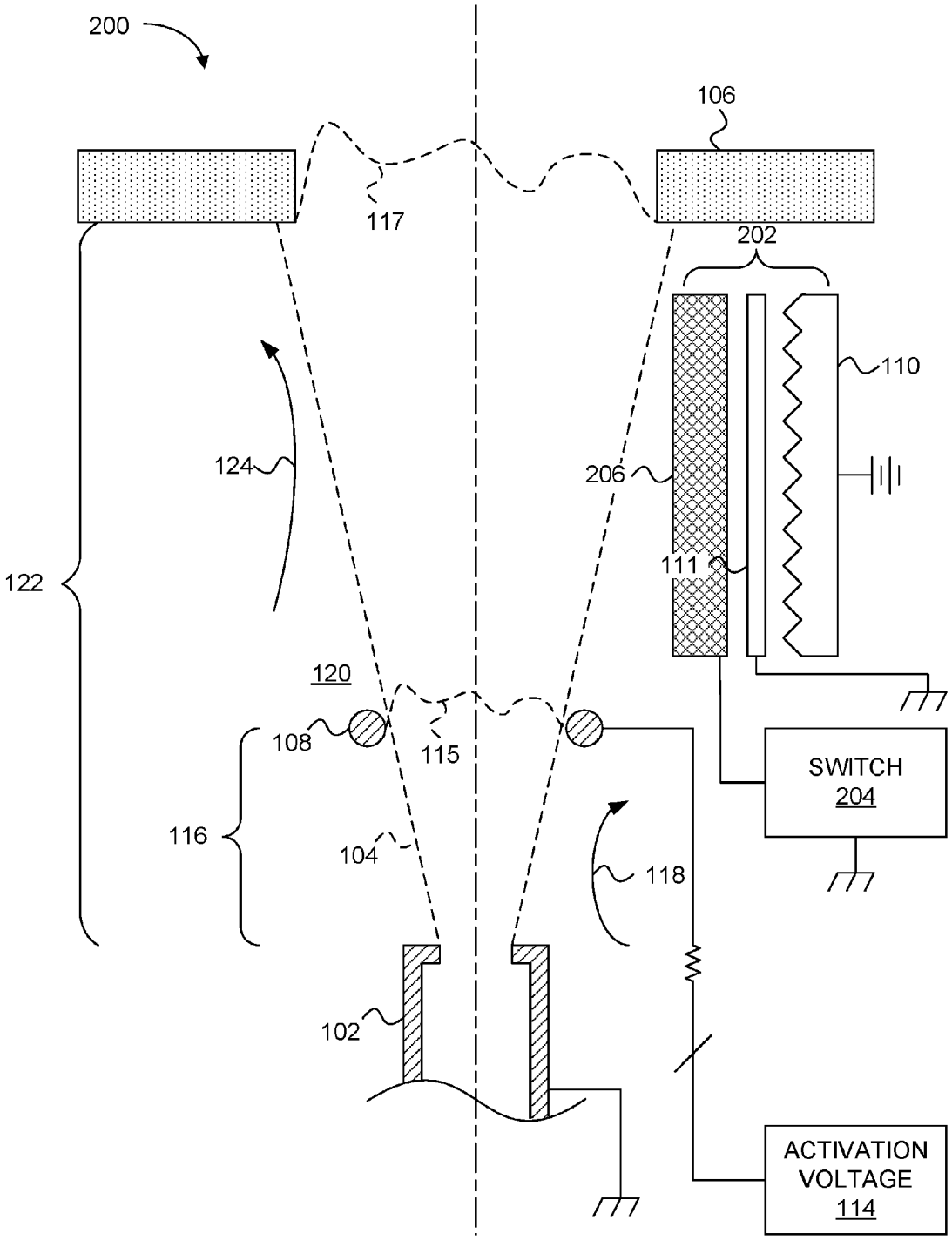
FIG. 2A is a sectional diagram of an oscillating combustor configured to support combustion with an oscillating fuel mixture responsive to interaction between a variable charge applied to a combustion fluid by a variable-current ionizer and an electrically conductive flame holder, according to an embodiment.
Figure 2B:
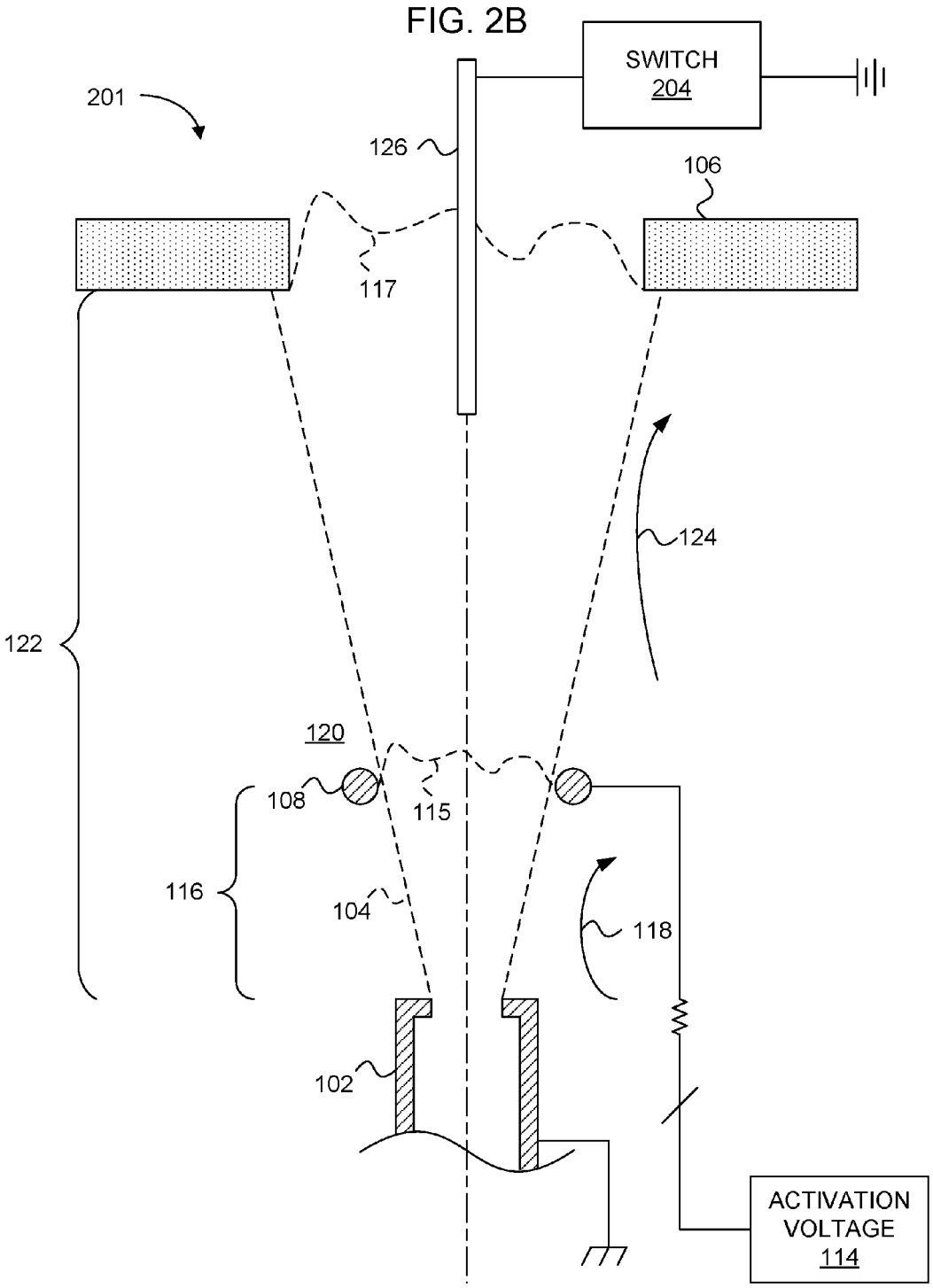
FIG. 2B is a side sectional diagram of an oscillation combustor configured to support combustion with an oscillating fuel mixture responsive to interaction between a variable voltage applied to a combustion fluid by a variable-voltage charge electrode and an electrically conductive flame holder, according to an embodiment.

FIGS. 2A and 2B are diagrams of an oscillating combustor 200, 201 configured to oscillate responsive to interaction between a variable charge applied to a flame or fuel stream by a variable-current ionizer 202 and a current channel in or associated with a proximal flame holder 108, according to an embodiment. FIG. 2A includes an ionizer 110 that outputs a switched charge flow. FIG. 2B includes a charge electrode 126 that outputs a switched voltage. The description below applies generally to both FIG. 2A and FIG. 2B except where context indicates otherwise.

The oscillating combustor 200, 201 includes a fuel nozzle 102 configured to emit an expanding area fuel jet 104. The fuel jet 104 can optionally be modulated in flow rate by a valve associated with the nozzle 102. However, the modulation in flame position alone (described herein) can provide modulation in fuel richness.

A first flame holder (also referred to as a distal flame holder) 106 is disposed distally along the fuel jet 104. The second flame holder (also referred to as a proximal flame holder) 108 is disposed proximally along the fuel jet 104. A variable-current ionizer 202 or variable-voltage charge electrode 126 is configured to apply a time-varying charge to the fuel jet 104 or a flame 115, 117 supported by the fuel jet 104. The variable-current ionizer 202 or variable-voltage charge electrode 126 is configured to periodically raise the combustion fluid (i.e., the fuel stream 104 or the flame 115, 117 supported by the fuel stream) to a time-varying high voltage.

The second flame holder 108 can be held in substantial continuity with an activation voltage 114. The activation voltage 114 can consist essentially of a voltage ground. Additionally or alternatively, the variable current ionizer 202 can be configured to apply a time-varying first polarity charge to the fuel jet 104 or flame. The second flame holder 108 can be held in substantial continuity with a voltage opposite in polarity to the first polarity.

The ionizer 202 can be configured to periodically apply charges to the fuel jet 104 or flame supported by the fuel jet 104 at a sufficiently high rate to cause the flame to carry a time-varying high voltage. Alternatively, a periodic high voltage can be directly applied by the charge electrode 126. The high voltage is ±1000 V or greater. For example, the ionizer 110 can be configured to cause the flame to carry a voltage having an absolute value of about 10 kilovolts or more.

The variable-current ionizer 202 can be configured to cause the flame to oscillate between a position at or near the first flame holder 106 and a position at or near the second flame holder 108. A rich flame front 115 can be held by the second flame holder 108 when the ionizer has charged the fuel. A lean flame front 117 can be held by the first flame holder 106 when the ionizer is off and/or when the charge on the fuel has dissipated (e.g., through the first flame holder 108). For example, the variable-current ionizer 202 can be configured to provide electrical current to the flame or the fuel jet 104 to hold the flame at or near the second flame holder 108 and to discontinue electrical current to the flame or fuel jet 104 to hold the flame at or near the first flame holder 106.

The variable-current ionizer 202 or variable voltage electrode 126 is configured to cause the flame to oscillate between positions corresponding to a rich mixture and a lean mixture. The rich mixture can include a time-averaged oxidizer concentration near a rich flammability limit of the fuel. The lean mixture can include a time-averaged oxidizer concentration near a lean flammability limit of the fuel. Alternatively, the flame can be controlled to not oscillate in holding positions per se, but rather to move in a varying position between the first flame holder 106 and the second flame holder 108.

Various hardware embodiments are contemplated. A digital- or analog-logic controlled switch 204 can operate similarly to and/or be formed from similar components as the continuity modulator 112 shown in FIGS. 1A and 1B. In some embodiments, the components 112 and 204 can be identical. Alternatively, the switch 204 can be configured to switch higher voltage than the continuity modulator 112. For example, in embodiments wherein a high voltage (greater than or equal to ±1000 volts magnitude) is switched onto a charge-ejecting portion 110 of the variable-current ionizer 202 or onto a charge electrode 126, the switch 204 can include a plurality of response-matched transistors that collectively switch the high voltage.

The switch 204 can include a transistor, such as an insulated gate bipolar transistor (IGBT). Alternatively, the switch 204 can include a mechanical switch, a relay, a solid state relay, a reed switch, discrete electrical components, a mercury switch, a cascade of transistors, or one or a cascade of tubes, for example. The switch 204 is operatively coupled to the variable-current ionizer 202 and is configured to control when the variable-current ionizer 202 or charge electrode 126 applies charge or voltage to the flame or fuel stream and when the variable-current ionizer 202 or charge electrode 126 does not apply charge to the flame or fuel stream.

A shield electrode 206 (also referred to as a grid electrode) can be operatively coupled to the switch 204. The switch 204 can be configured to control when the shield electrode 206 is allowed to electrically float and when the shield electrode 206 is placed in continuity with ground or a voltage between ground and a voltage at which the charge-ejecting portion 110 of the variable-current ionizer 202 is driven.

A high voltage source operatively coupled to the switch 204 can include a voltage multiplier, for example.

The oscillating combustor 200 can be configured to combust a time-series of rich and lean combustion packets. The rich combustion packets can have about 50% to 70% of the amount of oxygen required for stoichiometric combustion. The lean combustion packets can have about 130% to 150% of the amount of oxygen required for stoichiometric combustion.

The variable-current ionizer 202 can be configured to modulate charge to the fuel jet 104 or flame at a frequency of between about 0.5 and 15 Hertz, for example.

Figure 3:
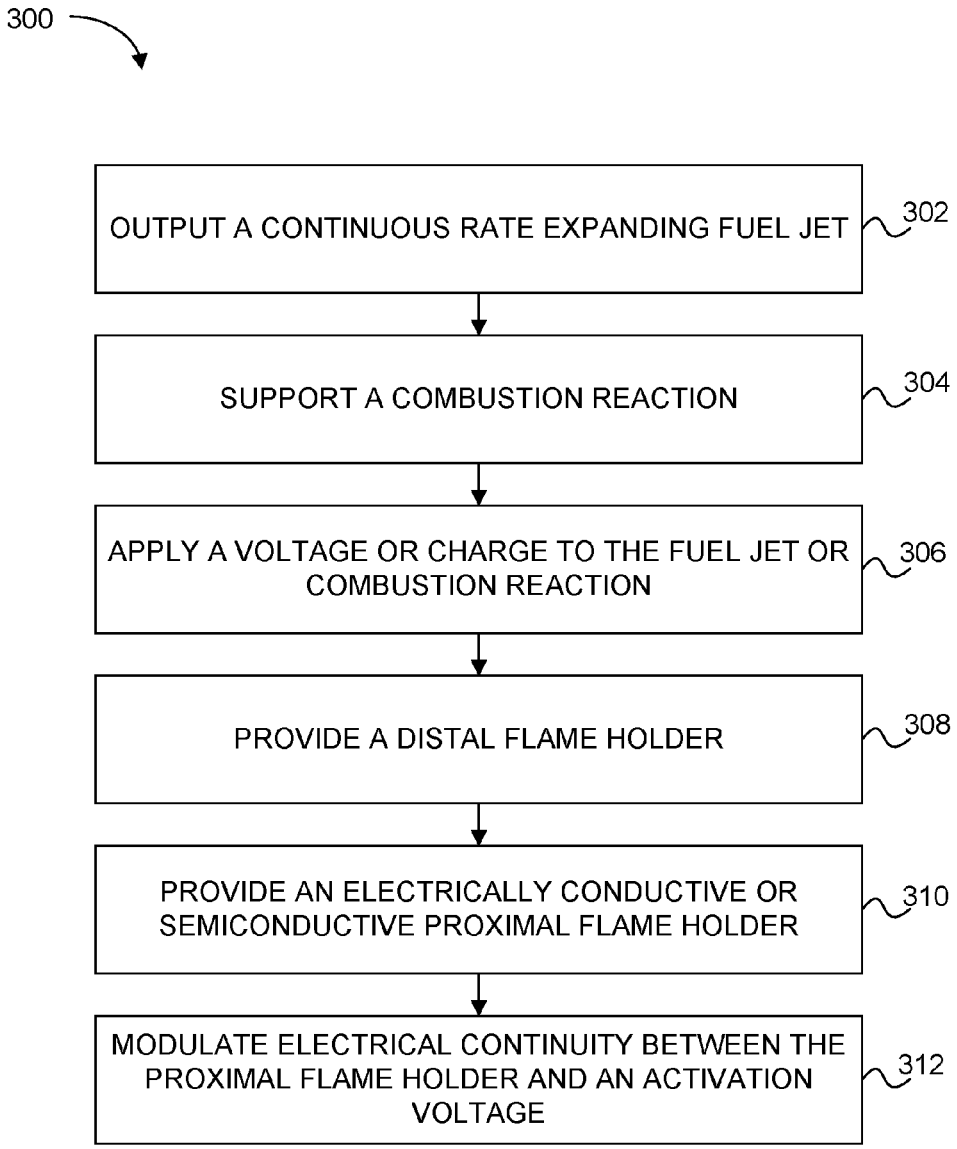
FIG. 3 is a flow chart showing a method for supporting an oscillating combustion reaction by applying a voltage or charge to a combustion fluid (fuel jet or a combustion reaction), and modulating electrical continuity between an activation voltage and an electrically conductive flame holder, according to an embodiment.

FIG. 3 is a flow chart showing a method 300 for supporting an oscillating combustion reaction by applying a voltage or charge to a fuel jet or the combustion reaction and modulating electrical continuity between an activation voltage and an electrically conductive flame holder, according to an embodiment. In step 302, a continuous rate, expanding area fuel jet can be output. Outputting a continuous rate, expanding area fuel jet can include outputting the fuel jet through air or flue gas. Outputting the fuel jet through air or flue gas can cause the fuel jet to entrain the air or flue gas to progressively dilute the fuel jet.

Various types of fuel jets can be output. According to an embodiment, the fuel jet can include a hydrocarbon gas such as natural gas (mostly methane) or a heavier gas such as ethane, propane, heated butane, or an unsaturated hydrocarbon such as acetylene. Because embodiments described herein result in lower combustion temperatures than stoichiometric hydrocarbon gas combustion, the methods and apparatuses described herein can optionally be used to control the temperature of a hydrocarbon gas flame. According to another embodiment, the fuel jet can include a gas mixture such as process gas. Process gas can include a mixture of methane, carbon monoxide, and hydrogen, for example. According to another embodiment the fuel jet can include a liquid and/or aerosol. For example, a liquid hydrocarbon such as cool butane, heptane, hexane or cyclohexane, gasoline, diesel oil, tall oil, bunker oil, or other hydrocarbon can be output as a stream, atomized stream, or aerosol. Liquid fuels can be heated as desired to achieve desired jet characteristics. According to another embodiment, a solid fuel such as an unsaturated hydrocarbon or substituted hydrocarbon (at a sufficiently high molecular weight and at a temperature corresponding to the solid state) or powdered coal can be used.

The continuous rate can be achieved by outputting fuel through an orifice without any modulation of the fuel flow rate, such as could be provided by a valve. In other embodiments, valve modulation can be combined with electrical modulation described herein. In such embodiments, a variable rate fuel jet can be substituted for the continuous rate fuel jet.

The expanding area of the output fuel jet is typically caused by incorporation of a surrounding gas into the fuel jet as it travels through its trajectory. The surrounding gas can include air or can include flue gas, for example. The progressive incorporation of the surrounding gas causes the fuel jet to become leaner and leaner as it travels through its trajectory. The variation in fuel mixture with distance from the fuel nozzle can be leveraged to cause a time-sequence or oscillation of rich and lean packets of fuel and air.

Proceeding to step 304, a combustion reaction can be supported with the fuel jet.

In step 306, a voltage or charge can be applied to the fuel jet or the combustion reaction. For example, an ion-ejecting electrode can be raised to a voltage at or above a corona inception voltage (e.g., a voltage determined according to Peek's Law to result in an ejection of ions). According to embodiments, an ion-ejecting electrode can be raised to a voltage of ±10,000 V to ±40,000 V. Lower or higher voltages can be used as desired. Additionally or alternatively, the voltage or charge can be applied to the fuel jet by one or more ionizers.

The applied voltage or charge can be continuous. That is, according to the embodiment 300 of FIG. 3, the voltage or charge on the fuel jet and the combustion reaction can be substantially constant because it is the periodic making and breaking of electrical continuity to the second conductive flame holder (described below) that causes the modulation in flame location that causes the modulation in relative mixture of the fuel and oxidizer.

In step 308 a first flame holder disposed distally along the fuel jet can be provided. Providing a first flame holder disposed distally along the fuel jet can include providing a refractory flame holder disposed adjacent to the fuel jet. The first flame holder can be disposed to be impinged upon by the fuel jet. The first flame holder can be disposed at a distance along the fuel jet selected to correspond to a lean fuel-to-oxidizer mixture.

Proceeding to step 310, a second flame holder can be disposed proximally along the fuel jet. Providing a second flame holder disposed proximally along the fuel jet can include providing a conductive metal second flame holder disposed adjacent to and/or peripheral to the fuel jet. Optionally, the second flame holder can be a semiconductive flame holder.

The second flame holder can be disposed at a distance along the fuel jet selected to correspond to a rich fuel-to-oxidizer mixture.

In step 312, electrical continuity between an activation voltage and the electrically conductive second flame holder can be modulated. Modulating the electrical continuity can include periodically making electrical continuity between the activation voltage and the second flame holder to cause the combustion reaction to be held by the second flame holder. Additionally, modulating the electrical continuity can include periodically breaking the electrical continuity between the activation voltage and the second flame holder. Periodically breaking the electrical continuity between the activation voltage and the second flame holder can cause the combustion reaction to be held by the first flame holder.

Modulating electrical continuity between the electrically conductive second flame holder and an activation voltage can include switching the electrically conductive second flame holder between the activation voltage and an electrically-isolated voltage that floats with the voltage or charge applied to the fuel jet or the combustion reaction.

Modulating electrical continuity between the electrically conductive second flame holder and an activation voltage can include switching the electrically conductive second flame holder between voltage opposite in polarity to a polarity of the voltage or charge applied to the fuel jet or the combustion reaction and an electrically-isolated voltage that floats with the voltage or charge applied to the fuel jet or the combustion reaction.

Modulating electrical continuity between the electrically conductive second flame holder and an activation voltage can include switching the electrically conductive second flame holder between substantially voltage ground and an electrically-isolated voltage that floats with the voltage or charge applied to the fuel jet or the combustion reaction.

In another embodiment, the electrically conductive second flame holder can be modulated between an activation voltage (such as ground or a voltage opposite in polarity from the charge or voltage applied to the fuel jet or combustion reaction) and a non-activation voltage. The non-activation voltage can be a voltage at the same polarity as the charge or voltage applied to the fuel jet or combustion reaction.

Modulating the electrical continuity between an activation voltage and the electrically conductive second flame holder can include modulating the continuity at a frequency of about 0.5 to 15 Hertz, for example.

Making the electrical continuity between second flame holder and the activation voltage can cause the combustion reaction to jump from the first flame holder up to the second flame holder. Breaking the electrical continuity between second flame holder and the activation voltage can cause the combustion reaction to jump from the second flame holder up to the first flame holder.

Because of the proximal location of the electrical conductive second flame holder, making electrical continuity between the electrically conductive second flame holder and the activation voltage can cause the combustion reaction to (periodically) occur at a rich fuel-to-oxidizer mixture. Causing the combustion reaction to periodically occur at a rich fuel-to-oxidizer mixture can include causing the combustion reaction to periodically occur at an oxidizer-to-fuel ratio of 0.5 to 0.7 times a stoichiometric oxidizer-to-fuel ratio. Additionally, causing the combustion reaction to periodically occur at a rich fuel-to-oxidizer mixture can include causing the combustion reaction to periodically occur at a reduced temperature compared to a combustion reaction at a stoichiometric fuel-to-oxidizer ratio.

Because of the distal location of the first flame holder, breaking electrical continuity between the second flame holder and the activation voltage can cause the combustion reaction to periodically occur at a lean fuel-to-oxidizer mixture corresponding to the distal location. Causing the combustion reaction to periodically occur at a lean fuel-to-oxidizer mixture can include causing the combustion reaction to periodically occur at an oxidizer-to-fuel ratio of 1.3 to 1.5 times a stoichiometric oxidizer-to-fuel ratio. Additionally, causing the combustion reaction to periodically occur at a lean fuel-to-oxidizer mixture can include causing the combustion reaction to periodically occur at a reduced temperature compared to a combustion reaction at a stoichiometric fuel-to-oxidizer ratio.

Figure 4:
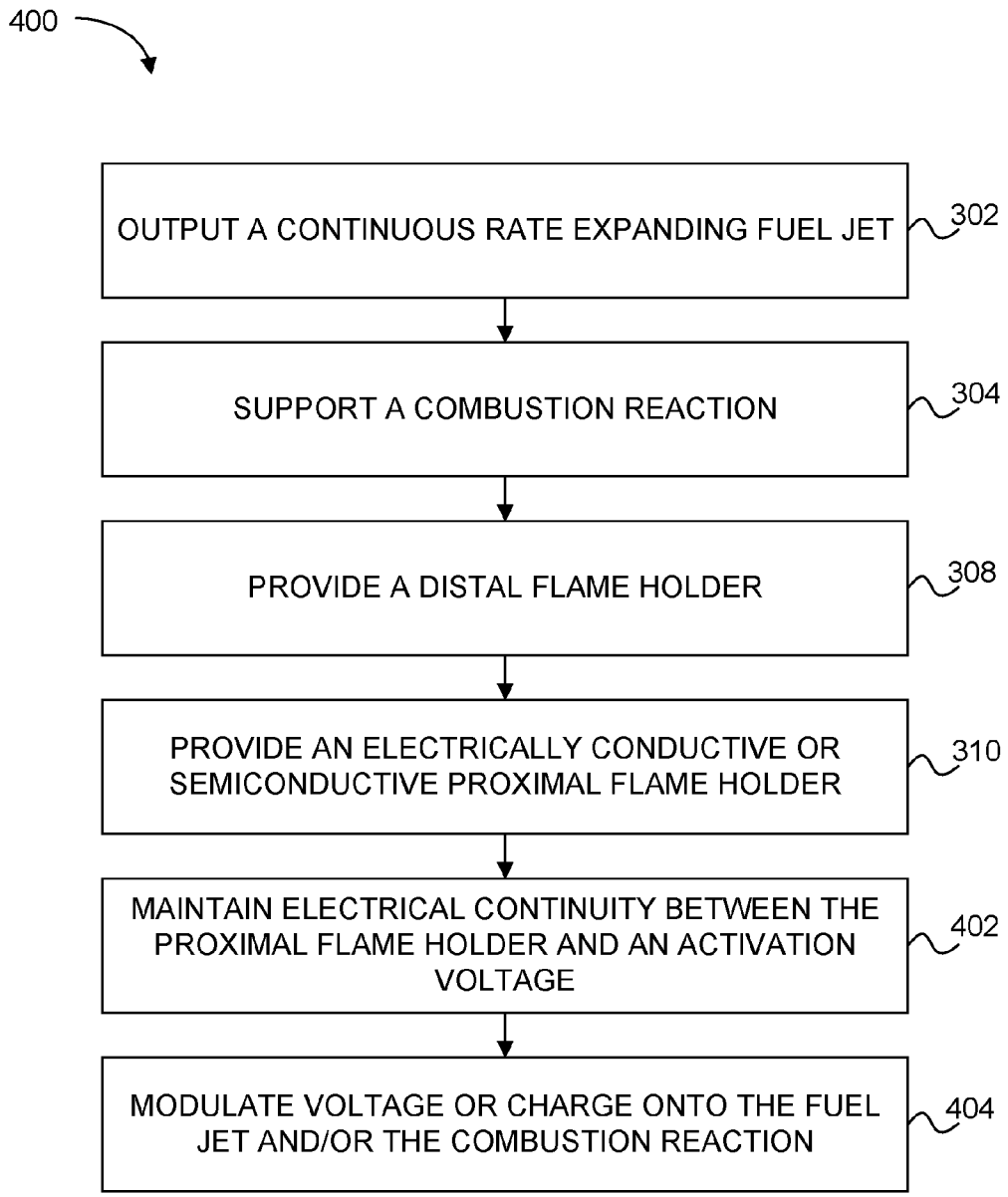
FIG. 4 is a flow chart showing a method for supporting an oscillating combustion reaction by providing an electrically conductive flame holder disposed proximally along the fuel jet and modulating a voltage or charge onto a combustion fluid, according to an embodiment.

FIG. 4 is a flow chart showing a method 400 for supporting an oscillating combustion reaction by providing an electrically conductive or semiconductive flame holder disposed proximally along the fuel jet and modulating a voltage or charge onto a fuel jet or the combustion reaction, according to an embodiment.

In step 302, an expanding area fuel jet can be output. The expanding fuel jet can be output at a substantially constant flow rate. Step 302 can occur as described in conjunction with FIG. 3, above. Optionally, the fuel jet can be variable rate, and effects arising from the variable rate of the fuel jet can be combined with effects arising from variable rate fuel jet charging or voltage application (as described below).

In step 304 a combustion reaction can be supported with the fuel jet. Various types of fuel jets are contemplated and are described above in conjunction with description corresponding to FIG. 3.

Proceeding to step 308 a first flame holder disposed distally along the fuel jet can be provided. Providing a first flame holder disposed distally along the fuel jet can include providing a refractory flame holder disposed adjacent to the fuel jet. The first flame holder can be disposed to be impinged upon by the fuel jet. As described in conjunction with FIG. 3, the first flame holder can be disposed at a distance along the fuel jet selected to correspond to a lean fuel-to-oxidizer mixture.

In step 310 a second flame holder disposed proximally along the fuel jet can be provided. Providing a second flame holder disposed proximally along the fuel jet can include providing a conductive metal second flame holder disposed adjacent to and/or peripheral to the fuel jet. Optionally, the second flame holder can be a semiconductive flame holder.

The second flame holder can be disposed at a distance along the fuel jet selected to correspond to a rich fuel-to-oxidizer mixture.

In step 402, electrical continuity between the electrically conductive second flame holder and an activation voltage can be maintained. The activation voltage can consist essentially of voltage ground or can include a voltage opposite in polarity from the charge or voltage applied to the fuel jet or combustion reaction.

Proceeding to step 404, a voltage or charge can be modulated (e.g., periodically applied) onto the fuel jet or the combustion reaction. Modulating the voltage or charge onto the fuel jet or the combustion reaction can include periodically applying the voltage or charge to the fuel jet or the combustion reaction to cause the combustion reaction to be held by or near the second flame holder and periodically discontinuing the voltage or charge to the fuel jet or the combustion reaction, to cause the combustion reaction to be held by or near the first flame holder.

Modulating a voltage or charge onto the fuel jet or the combustion reaction can include modulating the voltage or charge at a frequency of 0.5 to 15 Hertz, for example.

Modulating a voltage or charge onto the fuel jet or the combustion reaction can include modulating the voltage or charge between a voltage or charge at a first polarity and ground. Modulating the voltage or charge from a voltage or charge at a first polarity to ground can cause the combustion reaction to jump from the second flame holder to the first flame holder. Modulating the voltage or charge from ground to a voltage or charge at a first polarity can cause the combustion reaction to jump from the first flame holder to the second flame holder.

Periodically applying the voltage or charge to the fuel jet or the combustion reaction to cause the combustion reaction to be held by the second flame holder can cause the combustion reaction to periodically occur at a rich fuel-to-oxidizer mixture. Causing the combustion reaction to periodically occur at a rich fuel-to-oxidizer mixture can include causing the combustion reaction to periodically occur at an oxidizer-to-fuel ratio of 0.5 to 0.7 times a stoichiometric oxidizer-to-fuel ratio. Causing the combustion reaction to periodically occur at a rich fuel-to-oxidizer mixture can include causing the combustion reaction to periodically occur at a reduced temperature compared to a combustion reaction at a stoichiometric fuel-to-oxidizer ratio.

Periodically discontinuing the voltage or charge to the fuel jet or the combustion reaction to cause the combustion reaction to be held by the first flame holder can cause the combustion reaction to periodically occur at a lean fuel-to-oxidizer mixture. Causing the combustion reaction to periodically occur at a lean fuel-to-oxidizer mixture can include causing the combustion reaction to periodically occur at an oxidizer-to-fuel ratio of 1.3 to 1.5 times a stoichiometric oxidizer-to-fuel ratio. Causing the combustion reaction to periodically occur at a lean fuel-to-oxidizer mixture can include causing the combustion reaction to periodically occur at a reduced temperature compared to a combustion reaction at a stoichiometric fuel-to-oxidizer ratio.

Optionally, the methods described above in conjunction with FIG. 3 and FIG. 4 can be combined. For example, the voltage or charge on the fuel jet and the combustion reaction can be modulated (per the method 400) while electrical continuity between the electrically conductive second flame holder and the activation voltage is also modulated (per the method 300).

Optionally, the methods described above in conjunction with FIG. 3 and FIG. 4 can be combined with modulation of flow rate of the fuel jet.

While various aspects and embodiments have been disclosed herein, other aspects and embodiments are contemplated. The various aspects and embodiments disclosed herein are for purposes of illustration and are not intended to be limiting, with the true scope and spirit being indicated by the following claims.

What is claimed is:

1. An oscillating combustor, comprising:

a fuel nozzle configured to emit an expanding area fuel jet;

a first flame holder disposed distally along the fuel jet;

a second flame holder disposed proximally along the fuel jet; and a variable-charge ionizer configured to apply a time-varying charge to the fuel jet or a flame supported by the fuel jet;

one of a digital- or analog-logic controlled switch configured to control the variable current ionizer, wherein the time-varying charge is selected to cause a flame front supported by the fuel jet to oscillate in position between the first and second flame holders by; wherein the switch includes an insulated gate bipolar transistor (IGBT) operatively coupled to the variable-current ionizer and configured to control when the variable current ionizer applies charge to the flame or fuel stream and when the variable current ionizer does not apply charge to the flame or fuel stream.

2. The oscillating combustor of claim 1, wherein the fuel nozzle is configured to emit a substantially constant flow rate fuel jet.

3. The oscillating combustor of claim 1, wherein the fuel nozzle is configured to emit a variable flow rate fuel jet.

4. The oscillating combustor of claim 1, wherein the fuel nozzle is configured to emit a variable flow rate fuel jet that is synchronized with the time-varying charge applied by the variable-charge ionizer.

5. The oscillating combustor of claim 1, wherein the time-varying charge includes a high-voltage charge.

6. The oscillating combustor of claim 1, wherein the second flame holder is configured to be held in substantial continuity with an activation voltage source.

7. The oscillating combustor of claim 6, wherein the activation voltage source is configured to apply a voltage ground potential to the second flame holder.

8. The oscillating combustor of claim 1, wherein the ionizer is configured to apply a time-varying first polarity charge to the fuel jet or flame; and wherein the second flame holder is configured to be held in substantial continuity with a voltage opposite in polarity to the first polarity.

9. The oscillating combustor of claim 1, wherein the ionizer is configured to apply a charge to the fuel jet or flame supported by the fuel jet at a sufficiently high rate to cause the flame to carry a time-varying high voltage.

10. The oscillating combustor of claim 9, wherein the high voltage has an absolute value of 1000 V or higher.

11. The oscillating combustor of claim 9, wherein the ionizer is configured to cause the flame to carry a variable voltage having an absolute value of up to about 10 kilovolts or more.

12. The oscillating combustor of claim 1, wherein the variable-charge ionizer is configured to cause the flame to oscillate between a position near the first flame holder and a position near the second flame holder.

13. The oscillating combustor of claim 12, wherein the variable-current ionizer is configured to provide an electrical current to the flame or the fuel jet to hold the flame near the second flame holder.

14. The oscillating combustor of claim 12, wherein the variable-current ionizer is configured to discontinue electrical current to the flame or fuel jet to hold the flame near the first flame holder.

15. The oscillating combustor of claim 1, wherein the variable-current ionizer is configured to cause the flame front to oscillate between first and second positions corresponding to a rich mixture and a lean mixture, respectively.

16. The oscillating combustor of claim 15, wherein the rich mixture includes a time-averaged oxidizer concentration near a rich flammability limit of the fuel.

17. The oscillating combustor of claim 15, wherein the lean mixture includes a time-averaged oxidizer concentration near a lean flammability limit of the fuel.

18. The oscillating combustor of claim 1, further comprising:

a shield electrode operatively coupled to the switch;

wherein the switch is configured to control when the shield electrode is allowed to electrically float and when the shield electrode is placed in continuity with ground or a voltage between ground and a voltage to which a charge-ejecting portion of the ionizer is driven.

19. The oscillating combustor of claim 1, further comprising:

a voltage multiplier operatively coupled to the ionizer.

20. The oscillating combustor of claim 1, wherein the oscillating combustor is configured to combust a time-series of rich and lean combustion packets.

21. The oscillating combustor of claim 20, wherein the rich combustion packets have about half the amount of oxygen required for stoichiometric combustion.

22. The oscillating combustor of claim 20, wherein the lean combustion packets have about 1.3 to 1.5 times the amount of oxygen required for stoichiometric combustion.

23. The oscillating combustor of claim 1, wherein the variable current ionizer is configured to modulate charge to the fuel jet or flame at a frequency of between 0.5 and 15 Hertz.

* * * * *